United States Patent [19]

Stadie et al.

[11] 4,074,360

[45] Feb. 14, 1978

[54] FUEL AND FEEDWATER-MONITORING SYSTEM OF A ONCE-THROUGH STEAM GENERATOR

[75] Inventors: Lothar Stadie, Hochstadt; Eberhard Wittchow, Erlangen, both of Germany

[73] Assignee: Kraftwerk Union Aktiengesellschaft, Mulheim (Ruhr), Germany

[21] Appl. No.: 795,023

[22] Filed: May 9, 1977

[30] Foreign Application Priority Data

May 11, 1976 Germany ..... 2620734

[51] Int. Cl.[2] ..... G01L 03/26

[52] U.S. Cl. ..... 364/551; 364/105; 73/112; 122/448 R; 364/108

[58] Field of Search ..... 235/151.3; 73/112; 122/448 R

[56] References Cited

U.S. PATENT DOCUMENTS 2,596,030 5/1952 Junkins ..... 73/112

*Primary Examiner*—Eugene G. Botz

*Attorney, Agent, or Firm*—Herbert L. Lerner

[57] ABSTRACT

Monitoring system for a once-through steam generator for determining deviations between the amount of heat absorbed by the water and the steam of the generator and the amount of heat given off by a firing system for the generator during operating conditions that are not steady-state, as compared to steady-state operation, includes a first computing circuit responsive to a signal corresponding at least to an amount of fuel for determining a value approximately proportional to the amount of heat given off by the fuel, a second computing circuit responsive to a signal corresponding at least to an amount of feedwater for determining a value approximately proportional to the amount of heat absorbed by the water and the steam, a comparison circuit having inputs connected to respective outputs of the first and second computing circuits, a correction circuit connected between the output of one of the computing circuits and the respective input of the comparison circuit, the correction circuit including a correction member having an output variable only during an operating condition of the steam generator that is not steady-state, the variable output having an effect upon the value of the output of the one computer circuit that is fed to the respective input of the comparison circuit so that, during steady-state operation of the steam generator, the values of the outputs of the computer circuits to the inputs of the comparison circuit are returned as values representing substantially equal amounts of heat for heat given up by the fired fuel and for heat absorbed by the water and the steam.

6 Claims, 2 Drawing Figures

FUEL AND FEEDWATER-MONITORING SYSTEM OF A ONCE-THROUGH STEAM GENERATOR

Figure 1:
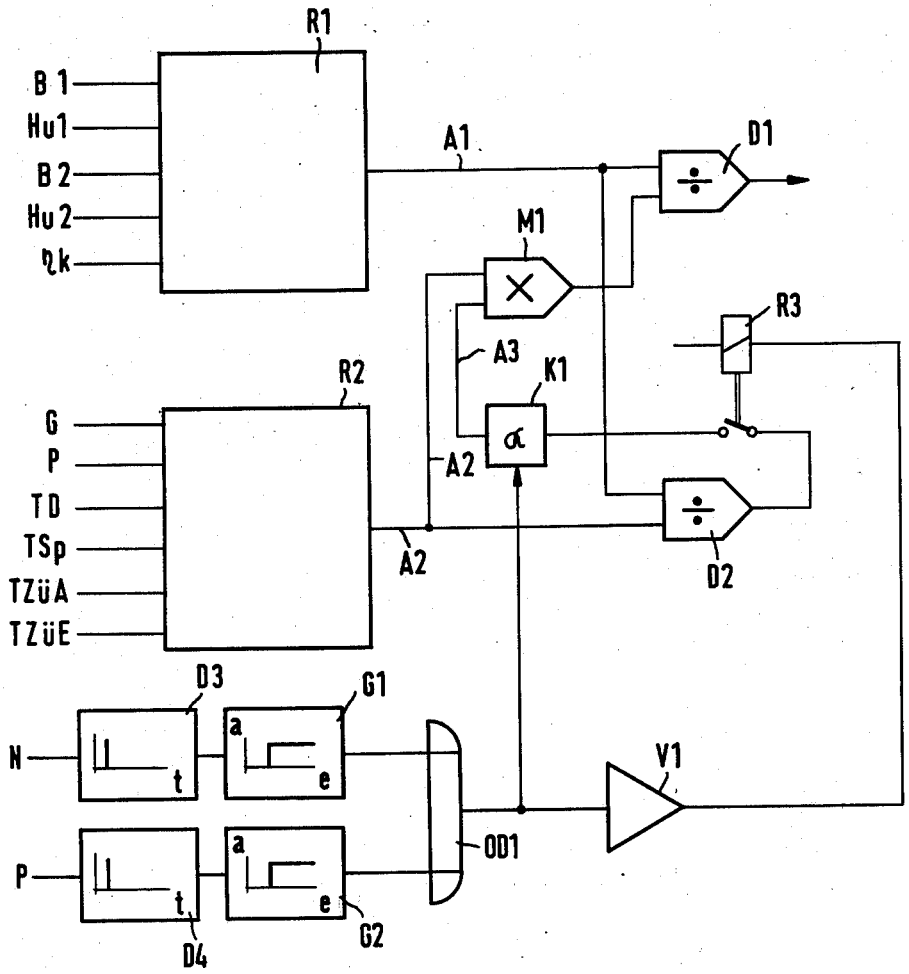

The invention relates to a fuel and feedwater monitoring system for a once-through steam generator to generate steam in power plants, once-through or continuous-flow boilers are generally installed wherein coils of tubes are wound around a combustion chamber and wherein the feedwater flowing in the tube coils is vaporized during the flow or passage thereof through the boiler.

An important underlying principle for the operation of such a continuous-flow or once-through boiler is the correct relationship or association of the firing capacity and the amount of feedwater. This relationship can be expressed by the so-called characteristic variable "fire/-water ratio". In this relationship the key word "fire" is understood to mean the thermal power transferred to water and steam due to the firing capacity. By the key word "water", there is meant the thermal power which is required due to the amount of feedwater, and which must be transferred to water and steam, in turbines with steam reheaters, in order to attain the desired live-steam and intermediate steam state.

The characteristic quantity "fire/water ratio" must have the value 1 in steady-state operation, at least in the long term, because otherwise variations in the steam pressure or in the steam temperature would occur. However, the determination of this characteristic quantity during operation of the steam generator presents difficulties, because variations in the heating value of the fuel, the soiling of the heating surfaces or varied firing schedule and thereby increased waste gas temperatures as well as other interference or disruptive variables cannot be detected at all or can be detected only with difficulty. For this reason, no comparison is made in the course of operation of a continuous-flow or once-through steam generator between the amount of heat absorbed by the water and the steam and the amount of heat delivered or given up by the firing system, or such a comparison would at least be burdened by very great inaccuracies.

It is accordingly an object of the invention of the instant application to provide a monitoring system of the foregoing type which makes it possible to effect this comparison in spite of the unavoidable inaccuracies which occur in determining the amounts of heat, in order to provide an important criterion for regulating or controlling the amount of fuel and feedwater under operating conditions that are nonstationary or not steady-state.

With the foregoing and other objects in view, there is provided, in accordance with the invention, a monitoring system for a once-through steam generator for determining deviations between the amount of heat absorbed by the water and the steam of the generator and the amount of heat given off by a firing system for the generator during operating conditions that are not steady-state, as compared to steady-state operation, comprising a first computing circuit responsive to a signal corresponding at least to an amount of fuel for determining a value approximately proportional to the amount of heat given off by the fuel, a second computing circuit responsive to a signal corresponding at least to an amount of feedwater for determining a value approximately proportional to the amount of heat absorbed by the water and the steam, a comparison circuit having inputs connected to respective outputs of the first and second computing circuits, a correction circuit connected between the output of one of the computing circuits and the respective input of the comparison circuit, the correction circuit including a correction member having an output variable only during an operating condition of the steam generator that is not steady-state, the variable output having an effect upon the value of the output of the one computer circuit that is fed to the respective input of the comparison circuit so that, during steady-state operation of the steam generator, the values of the outputs of the computer circuits to the inputs of the comparison circuit are returned as values representing substantially equal amounts of heat for heat given up by the fired fuel and for heat absorbed by the water and the steam.

In accordance with another feature of the invention, the comparison circuit for the amounts of heat is a divider.

In accordance with a further feature of the invention, the monitoring system includes a circuit for determining the steady-state operating condition of the steam generator comprising at least one differentiating device having an input connected to a signal source representing a parametric value of the steam generator selected from the group of parametric values consisting of power output and pressure, and a limit value indicator connected to the differentiating device at the load side thereof.

In accordance with an added feature of the invention, the computer circuits have respective output lines and the correction circuit includes a divider having two inputs respectively connected to the output lines and having an output, the correction member of the correction circuit being a mean value-forming device and having an input connected to the output of the divider, the correction circuit including a multiplier having two inputs respectively connected to the output of the one computer circuit and to the output of the correction member.

In accordance with an additional feature of the invention, the comparison circuit is a divider, and the output of the one computer circuit forms the denominator in the divider of a ratio of the amount of heat given off by the fired fuel to the amount of heat absorbed by the water and the steam.

In accordance with a concomitant feature of the invention, the comparison circuit is a divider having two inputs and the computer circuits have respective output lines, the output lines of one of the computer circuits being connected to one of the divider inputs, the correcting circuit including a multiplier having an output connected to the other input of the divider, the multiplier having two inputs, one of which is connected to the output line of the other of the computer circuits and the other of which is connected to the output of the correcting device of the correcting circuit.

Other features which are considered as characteristic for the invention are set forth in the appended claims.

Although the invention is illustrated and described herein as embodied in fuel and feedwater-monitoring system of a once-through steam generator, it is nevertheless not intended to be limited to the details shown, since various modifications and structural changes may be made therein without departing from the spirit of the invention and within the scope and range of equivalents of the claims.

Figure 2:
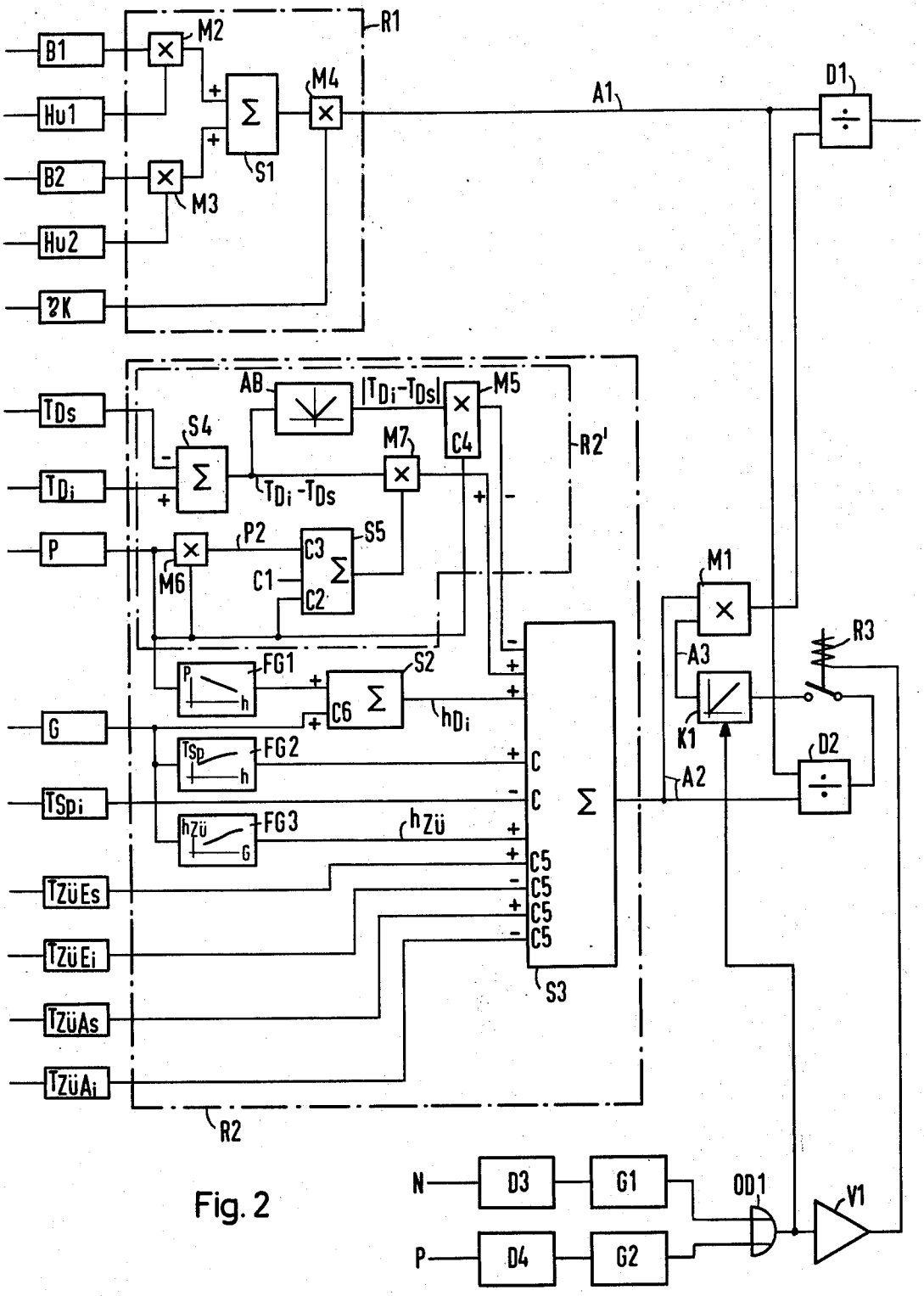

The construction and method of operation of the invention, however, together with additional objects and advantages thereof will be best understood from the following description of specific embodiments when read in connection with the accompanying drawings, in which:

FIG. 1 is a schematic view of the fuel and feedwater monitoring system for a once-through steam generator in accordance with the invention; and FIG. 2 is another view of FIG. 1 showing various components thereof in great detail.

Am embodiment of the fuel and feedwater monitoring system for a once-through steam generator is illustrated, in principle, in the figures of the drawing. The system includes a first computer circuit R1, to which, as input variables, two different amounts of fuel B1 and B2, for example, for oil and coal firing, respectively, as well as respective not calorific powers or values Hu1 and Hu2 of the fuels B1 and B2, have been fed. In addition, an input variable of $\eta K$ is provided for this computer circuit R1 which represents the value of the boiler efficiency. A multiplier M2 is provided in the computer circuit R1, to which the quantity of the fuel B1 and the corresponding net calorific power Hu1 of the fuel B1 are fed as input variables. In a similar manner, another multiplier M3 is provided which receives the quantity of the fuel B2 and the corresponding net calorific power Hu2 of this fuel B2 as input variables. The calorific powers or values of the supplied quantities of fuel B1 and B2 are obtained, respectively, at the outputs of the multipliers M2 and M3. These calorific powers or values are added in a summing or adding network S1 to which the outputs of the multipliers M2 and M3 are connected as inputs, and the output of the summing or adding network S1 is fed to another multiplier M4 together with an input of the boiler efficiency $\eta K$ wherein both values are multiplied. An output line A1 is connected to the output of the multipler 4 and accordingly transmits an analog signal which corresponds to the energy which the water or the steam of the steam generator receives, fed thereto on the fuel side, during the respective operating condition. The following equation applied thereto:

$$A1 = [(B1 \cdot Hu1) + (B2 \cdot Hu2)] \cdot \eta K.$$

A second computer circuit R2 is additionally provided, which is designated for determining the amount of heat actually absorbed by the water and steam. Inputs corresponding to the rated or nominal temperature $T_{Ds}$ and the actual temperature $T_{Di}$, the steam pressure P, the amount of feedwater G, the feedwater temperature $T_{Spi}$, the nominal values of the intermediate superheater temperature at the inlet and the outlet $T_{Z\ddot{u}Es}$ and $T_{Z\ddot{u}As}$, respectively, and the actual values of the intermediate superheater temperatures at the inlet and the outlet $T_{Z\ddot{u}Ei}$ and $T_{Z\ddot{u}Ai}$ are fed to the second computer circuit R2. To calculate the actual enthalpy-difference between that of the feedwater fed to the steam generator and that of the live steam withdrawn from the steam generator, the value of the steam pressure P is fed to a function generator FG1. The curve plotted in the box representing the function generator FG1 shows that a high enthalpy exists at a low pressure, and a low enthalpy at a high pressure between the inlet and the outlet of the steam generator. The output of the function generator FG1 is connected to an input of a summing or adding network S2 to take into account the effect of the feedwater. Another input to the adding network S2 is connected to a signal source of the input variable for the amount of feedwater G, because the enthalpy difference between the feedwater and the live steam is proportional to the amount of feedwater. A factor C6 is introduced into the adding network as a proportionality factor. The output value for the amount of feedwater G is multiplied by the factor C6, before the addition to the output of the function generator FG1 occurs in the adding network S2. The output of the adding network S2, which represents the enthalpy difference $h_{Di}$, is connected with a positive sign to an input of another summing or adding network S3 wherein all of the parametric values which have an effect upon the enthalpy of the live steam are added together. Since the enthalpydifference $h_{Di}$ at the output of the adding network S2 is identical with the actual enthalpy-difference of the steam only if the steam temperature at the outlet of the steam generator corresponds to the nominal value thereof thereat, the computer circuit R2 is provided with a sub-circuit R2' for correcting the error which is thereby produced and which reproduces the following equation:

$$\Delta h_D = (T_{Di} - T_{Ds}) \cdot [C1 + (C2 \cdot P) + (C3 \cdot P2)] - (|T_{Di} - T_{Ds}| \cdot C4 \cdot P)$$

The terms C1 to C4 represent constant values that are employed or set in accordance with the respective system. The computer subcircuit R2' includes a summing or adding network S4 which has inputs connected to the sources of the input variables for the live steam nominal and actual temperatures $T_{Ds}$ and $T_{Di}$, respectively. As the signs at the respective inputs to the adding network S4 in FIG. 2 indicate, the difference between both of the temperature values $T_{Ds}$ and $T_{Di}$ is determined in the adding network S4. An obsolute value-forming network AB is connected to the output of the adding network S4, and the absolute value of the temperature differences $|T_{Ds}$ and $T_{Di}|$ is accordingly transmitted from the output of the network AB through a multiplier M5 with a negative sign to the adding network S3. A second input to the multiplier M5 is the output of the signal source for the steam pressure P. The term C4 shown in the box representing the multiplier M5 in FIG. 2 indicates that the value representing the steam pressure is multiplied thereat additionally constant C4. the constance C4. The source of the signal representing the steam pressure P is, moreover, connected to both inputs of a multiplier M6, so that the output P2 of which has the mathematical value $P^2$. The output P2 is connected to the input of a summing or adding network S5. After the value P2 has been initially multiplied with a factor C3, the product thereof is added to a value C1 that is also fed to an input of the adding network S5, and further added to the product of a value C2 and the pressure P that is introduced to the adding network S5 through yet another input thereof that is connected to the output of the source of the signal representing the steam pressure P. The output of the adding network S5 is connected to a first input of a multiplier M7. A second input of the multiplier M7 is connected to the output of the adding network S4. The multiplier M7 has an output which is connected with a positive sign to an input of the adding network S3. Accordingly, the adding network S3 receives, through the two input lines thereto shown uppermost in FIG. 2, a correction value $\Delta h_D$ in accordance with the last-mentioned equation. This correction value takes into account the effect of the deviation of the actual steam temperature at the outlet of the steam generator from the respective nominal or theoretical value thereof.

Another function generator FG2 is connected to the input for the quantity of the feedwater G and delivers at the output thereof a feedwater nominal temperature value $T_{Sp}$ that is dependent upon the quantity of the feedwater G. The output of the function generator FG2 is connected with a positive sign to an input of the adding network S3. The input variable for the feedwater temperature $T_{Spi}$ is fed with a negative sign to another input of the adding network S3. A third function generator FG3 has an input which is also connected to the source of the input variable for the quantity of the feedwater G and serves to deliver at the output thereof a value that is proportional to the difference of the intermediate superheater enthalpy $h_{Zu}''$ between the inlet and the outlet of the intermediate superheater. This last-mentioned value is fed with a positive sign to another input of the adding network S3.

Additional input variables are fed to respective inputs of the adding network S3, namely the intermediate superheater nominal temperatures at the inlet and outlet thereof $T_{Zu''Es}$ and $T_{Zu''As}$, respectively, both with a positive sign, and the intermediate superheater actual temperatures at the inlet and outlet thereof $T_{Zu''Ei}$ and $T_{Zu''Ai}$, respectively, both with a negative sign. All of these values are added together in the adding network S3, taking into account the respective signs thereof and, where necessary, after being multiplied by a proportionality factor C or C5, so that a value according to the following equation is produced in the output line A2 of the computer circuit R2:

$$A2 = G \cdot (h_D + h_{Zu}'' + \Delta h_D + \Delta h_{Sp}).$$

Furthermore, a circuit shown at the bottom of FIGS. 1 and 2 is provided for determining whether an operating condition which is steady-state or is not steady-state is present. For this purpose, the output power N of the steam boiler and the steam pressure P are each fed to respective inputs of respective differentiating members D3 and D4, the outputs of which are connected to respective inputs of limit value or critical value indicators G1 and G2 and, in turn, therefrom to an input of an OR-gate OD1. Thus, a signal is always obtained at the output of the OR-gate OD1, if the power output of the steam generator (steam quantity) or the steam pressure varies by a given amount per unit time. The output of the OR-gate OD1 is fed to a correction member K1 and is additionally connected through an amplifier V1 to a relay R3. The relay R3 has a contact that is connected on the load side of a divider D2 which is, in turn, connected, on the input side thereof, to the output lines A1 and A2. The contact of the relay R3 is always supposed to be open if no steady-state operating condition exists. The correction member K1 is an integration network having an output that adjusts to the value of the input as long as an input voltage is present, the output assuming a constant, unvarying value if the input voltage is absent, which is the case, for example, when the contact of the relay R3 is opened.

The divider D2 divides the values on the output lines A1 and A2 and must have the value 1 in the steady-state condition, if the computing circuits R1 and R2 have, in fact, determined the correct amounts of heat of the steam generator. The inaccuracies mentioned at the introduction to this specification, which produce errors in the determination of these amounts of heat, cause the output value of the divider D2 to deviate from the value 1, however. In the steady-state operating condition of the steam generator, the output of the divider D2 is therefore connected to the input of the correction member K1 through the coled contact of the relay R3.

This correction member K1 then compares the output value of the divider D2 with the correct value 1, which is obtained when the computing circuits operate correctly, and slowly varies the output value thereof on the output line A3, with an adjustable time delay, to a value corresponding to the output value at the divider D2. The correction member thus operates as a mean or average value-forming device. In the multiplier M1, which is connected on the input side thereof to the output line A3 and the output line A2, the corrected output value on the line A3 is now multiplied by the output value of the computing circuit R2. The output of the multiplier M1 is connected to one input of a divider D1, a second input of which is connected to the output line A1.

The divider D1 thereby serves as a comparison member for the two computing circuits R1 and R2 and furnishes at the output thereof, during non-steady-state conditions, the information desired regarding the ratio of the amount of heat transferred to the water and steam by the firing system, to the amount of heat absorbed by the water.

Assuming that, due to a change in the composition of the fuel or soiling of heat surfaces, a deviation of the output value of the computing circuit R1 from the correct value of the amount of heat transferred to the water and steam by the firing system occurs, then, during steady-state operation of the steam generator, the correction member K1 will have such an effect upon the output value of the computing circuit R2 through the multiplier M1, that the value 1 will be present at the output of the divider D1 over the long term, in spite of this deviation.

If an operating condition that is not steady-state is produced, the correction member K1 is blocked or cut off by the output signal at the OR-gate OD1 and it does not, therefore, vary the output value thereof any longer from this instant on. In addition, the contact of the relay R3 is opened, so that the connection between the divider D2 and the correction member K1 is interrupted.

Thus, a signal appears at the output of the divider D1 which, eliminating all inaccuracies that have occurred in the determination of the amounts of heat during the preceding steady-state operating condition, has a value that indicates by how much the amount of heat given off or transferred by the firing system to the water exceeds or falls below the amount of heat absorbed by the water and the steam. This value can either be indicated or used as input variable in an automatic control device for the steam generator.

There are claimed:

1. Monitoring system for a once-through steam generator for determining deviations between the amount of heat absorbed by the water and the steam of the generator and the amount of heat given off by a firing system for the generator during operating conditions that are not steady-state, as compared to steady-state operation, comprising a first computing circuit responsive to a signal corresponding at least to an amount of fuel for determining a value approximately proportional to the amount of heat given off by the fuel, a second computing circuit responsive to a signal corresponding at least to an amount of feedwater for determining a value approximately proportional to the amount of heat absorbed by the water and the steam, a comparison circuit having inputs connected to respective outputs of said first and second computing circuits, a correction circuit connected between the output of one of said computing circuits and the respective input of said comparison circuit, said correction circuit including a correction member having an output variable only during an operating condition of the steam generator that is not steady-state, said variable output having an effect upon the value of the output of said one computer circuit that is fed to the respective input of said comparison circuit so that, during steady-state operation of the steam generator, the values of the outputs of said computer circuits to the inputs of said comparison circuit are returned as values representing substantially equal amounts of heat for heat given up by the fired fuel and for heat absorbed by the water and the steam.

2. Monitoring system according to claim 1 wherein said comparison circuit for the amounts of heat is a divider.

3. Monitoring system according to claim 1 including a circuit for determining the steady-state operating condition of the steam generator comprising at least one differentiating device having an input connected to a signal source representing a parametric value of the steam generator selected from the group of parametric values consisting of power output and pressure, and a limit value indicator connected to said differentiating device at the load side thereof.

4. Monitoring device according to claim 1 wherein said computer circuits have respective output lines and wherein said correction circuit includes a divider having two inputs respectively connected to said output lines and having an output, said correction member of said correction circuit being a mean value-forming device and having an input connected to said output of said divider, said correction circuit including a multiplier having two inputs respectively connected to said output of said one computer circuit and to said output of said correction member.

5. Monitoring device according to claim 4 wherein said comparison circuit is a divider, and the output of said one computer circuit forms the denominator in the divider of a ratio of the amount of heat given off by the fired fuel to the amount of heat absorbed by the water and the steam.

6. Monitoring device according to claim 1 wherein said comparison circuit is a divider having two inputs and said computer circuits have respective output lines, the output line of one of said computer circuits being connected to one of said divider inputs, said correcting circuit including a multiplier having an output connected to the other input of said divider, said multiplier having two inputs, one of which is connected to the output line of the other of said computer circuits and the other of which is connected to said output of said correcting device of said correcting circuit.

* * * * *